US006853832B2

(12) United States Patent
Noya et al.

(10) Patent No.: US 6,853,832 B2
(45) Date of Patent: Feb. 8, 2005

(54) COMPACT IMAGE FORMING APPARATUS

(75) Inventors: Motoi Noya, Kanagawa (JP); Yutaka Nogami, Kanagawa (JP); Yoshio Kanesawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/382,622

(22) Filed: Mar. 7, 2003

(65) Prior Publication Data

US 2004/0081489 A1 Apr. 29, 2004

(30) Foreign Application Priority Data

Oct. 29, 2002 (JP) ..... 2002-314170
Oct. 29, 2002 (JP) ..... 2002-314177
Oct. 29, 2002 (JP) ..... 2002-314188

(51) Int. Cl.[7] ..... G03G 15/20
(52) U.S. Cl. ..... 399/328; 399/341
(58) Field of Search ..... 399/322, 328, 399/329, 341, 342, 122; 219/216

(56) References Cited

FOREIGN PATENT DOCUMENTS

JP 4-31393 B 5/1992
JP 5-158364 6/1993

*Primary Examiner*—William J. Royer
(74) *Attorney, Agent, or Firm*—Morgan, Lewis & Bockius LLP

(57) ABSTRACT

The present invention provides an image forming apparatus having dimensions comparable to or smaller than those of conventional color image forming apparatus and adapted to produce a hard copy of photographic image quality. The image forming apparatus of the present invention has a first fixing device that fixes a toner image transferred to a recording medium, a second fixing device that re-fixes the toner image fixed on the recording medium by the first fixing device, and a switch section that selects the first route or the second route for the recording medium to be discharged. The first route passes through the first fixing device and allows the recording medium to be discharged immediately thereafter without passing through the second fixing device. The second route passes through the first fixing device and subsequently the second fixing device, and then allows the recording medium to be discharged.

17 Claims, 8 Drawing Sheets

COMPACT IMAGE FORMING APPARATUS

BACKGROUND OF THE INVENTION

1. Field of the Invention

The present invention relates to an image forming apparatus that can be used for an electrophotographic copying machine or a printer.

2. Description of the Related Art

The development of the highly computerized society in recent years has entailed the current popularity of copying machines and printers that are being used not only in offices but also in ordinary homes. At the same time, the trend of down-sizing such apparatus is advancing. Meanwhile, various mobile equipments like color television sets, color displays of personal computers and game machines available these days have been rapidly developed to provide color images. Similarly, colorization of electrophotographic copying machines and printers is remarkably advancing. To reflect the development of various colorized mobile equipments and their popularity, many book stores, convenience stores and other stores currently have color copying machines and color printers that are publicly accessible and hence people can use them for the purpose of copying various documents and leaflets they want even if they are away from the office or the home.

Particularly, the popularity of digital still cameras is remarkable in these days. This is mainly because the user can shoot a scene while monitoring the picked up image of the scene and replay the recorded image and also because the user can transmit the obtained image by way of a communication network. There seem to be many people who want to obtain hard copies of the picture taken by a digital still camera by means of a color printer.

Existing electrophotographic printers and copying machines for black and white images are mostly adapted to produce less glossy images by regulating the fixing temperature and the fixing time of toner because it is rather difficult to read letters printed on glossy paper. While electrophotographic printers and copying machines for producing color images such as graphics and diagrams have become available recently, they essentially employ a mechanism similar to its counterpart for black and white images so that the user may be able to regulate the fixing temperature and the fixing time of toners by selecting a desired processing speed.

However, it is preferred to want to have hard copies of pictures taken by digital still cameras that are as glossy as photographs. Therefore, electrophotographic printers and copying machines for producing glossy images need to use a mechanism basically different from the one for producing black and white images and/or color images such as graphics.

There have been proposed image forming apparatus provided with an annexed unit for outputting highly smooth and highly glossy images in addition to a conventional unit (see, inter alia, Patent Document 1).

FIG. 1 of the accompanying drawings is a schematic view of such an image forming apparatus provided with an annexed unit for outputting highly smooth and highly glossy images in addition to a conventional unit.

The image forming apparatus shown in FIG. 1 has a main body section 101 and an annexed unit 150 containing a belt fixing device, paper feed roll and so on.

The main body section 101 has an image processing section 104 for converting red (R), green (G) and blue (B) colors of the image data readout from an image reading section (not shown) or externally input into yellow (Y), magenta (M), cyan (C) and black (K) colors, a sensitized body 107 adapted to rotate in the sense of arrow A in FIG. 1 to form a toner image, a charger 108 for uniformly charging the sensitized body 107 with electricity, an exposure section 105 for irradiating light modulated according to the image data of Y, M, C and K colors output from the image processing section 104 to the sensitized body 107 that has been electrically charged to form electrostatic images of Y, M, C and K colors, a rotary developing device 109 for containing toners 109Y, 109M, 109C and 109K of different colors fed respectively from toner boxes 135 of Y, M, C and K colors and developing the electrostatic latent images of Y, M, C and K colors on the sensitized body 107 by means of toner of the respective colors to form toner images of Y, M, C and K colors on the sensitized body 107 and a cleaner 132 for cleaning out the residual toner after transferring the toner images.

The main body section 101 further has an intermediate transfer belt 111 held by a drive roll 113, a tension rolls 114 and an opposite roll 115 and driven to move around in the direction of arrow B in FIG. 1 while being held in contact with the sensitized body 107, a primary transfer roll 112 that forms a nip section with the sensitized body 107 with the intermediate transfer belt 111 held between them and is adapted to transfer toner images on the sensitized body 107 to the intermediate transfer belt 111 and a secondary transfer roll 117 that forms another nip section with the opposite roll 115 with the intermediate transfer belt 111 held between them and is adapted to secondarily transfer the toner images on the intermediate transfer belt 111 to a sheet of paper P.

The main body section 101 additionally has a sheet tray 118 containing sheets of paper P to be used for forming images thereon, a conveyance route 120 along which each sheet of paper P drawn out of the sheet tray 118 is conveyed to the secondary transfer position where a toner image is transferred onto it, a conveyance belt 121 for conveying the sheet of paper P carrying toner images to a fixing position and a roll fixing device 125 for fixing the toner images on the sheet of paper P by nipping it between a pair of rolls 122, 123 and applying heat and pressure to it.

The sensitized body 107 that is uniformly charged with electricity by the charger 108 is exposed by the exposure section 105 to light modulated according to the image data of Y, M, C and K colors to form electrostatic latent images thereon, which are then developed by the developing device 109 to produce toner images of Y, M, C and K colors. The toner images of Y, M, C and K colors are then sequentially transferred to the circulating intermediate transfer belt 111 one on the other by the primary transfer roll 112 so that a toner image of Y, M, C and K colors is formed on the intermediate transfer belt 111 by superposition. The multicolored toner image is then secondarily transferred to the sheet of paper P by the secondary transfer roll 117 and fixed to the sheet of paper P by the roll fixing device 125.

The image forming operation is terminated here in the case of forming an image of ordinary image quality. Then, a conveyance route switch 152 is turned to the side of a discharge roll 154 and the sheet of paper P carrying the image fixed by the roll fixing device 125 is delivered to a discharge section 155 of the annexed unit 150 by way of the discharge roll 154.

In the case of forming a highly glossy photographic image, on the other hand, a sheet of coat paper having a surface layer of thermoplastic resin that operates as an image receiving layer is fed either from a dedicated tray (not shown) or from a tray 134 where a number of sheets of coat paper have been manually stored. Subsequently, as a result of passing through the steps described above for an image of ordinary image quality, a multicolored toner image is secondarily transferred onto the sheet of coat paper and the image formed by the superposition is fixed by the roll fixing device 125. Then, the conveyance route switch 152 is turned to the side of the conveyance rolls 157 and the sheet of coat paper is fed to a belt fixing device 158 in the annexed unit 150 by way of the conveyance rolls 157. The belt fixing device 158 has an endless belt that runs and is held by a roll having a heat source in the inside. Thus, as the surface of the sheet of coat paper P that carries the fixed toner image is laid on the endless belt, the fixed toner image on the sheet of paper P is gradually heated again and smoothed. Then, the heater toner image is cooled by a cooling member (not shown) and solidified to become a highly glossy image.

Thus, a belt fixing device 158 is used in order to provide a long fixing time when forming an image of photographic image quality. The belt fixing device 158 requires a relatively large space if compared with a roll fixing device for producing an image of ordinary image quality. Therefore, an image forming apparatus adapted to produce a highly glossy image has dimensions that are twice as large as an apparatus for producing only an ordinary image if such an annexed unit is used.

There is also an image forming apparatus provided with a belt fixing device in addition to a conventional roll fixing device, in which the two fixing devices are arranged in series. In this apparatus, the sheet of paper to which toner images have been transferred is driven to pass either of the two fixing devices or both of them. If it is made to pass through the two fixing devices, a glossy image, a semi-glossy image or a non-glossy image can be obtained by changing the order in which the sheet of paper is made to pass through the fixing devices (see, inter alia, Patent Document 2).

[Patent Document 1]

Japanese Patent Publication No. 4-31393 (Page 2, FIG. 1)

[Patent Document 2]

Japanese Patent Application No. 5-1583864 (Paragraph No. 0007 through Paragraph No. 0014, Paragraph No. 0018 through Paragraph No. 0031, FIGS. 2 through 4).

However, an image forming apparatus as disclosed in Patent Document 1 contains a unit for forming a highly smooth and glossy image that is arranged in juxtaposition with the unit for forming an ordinary image and therefore, it requires internal space for containing two units. Also, two fixing devices of different types are arranged horizontally in series in an image forming apparatus as disclosed in Patent Document 2, and therefore, the entire image forming apparatus has large dimensions so that, once again, it requires large internal space if compared with conventional apparatus.

While various information-related apparatus have been down-sized in recent years, the number of installed apparatus has been increasing. This means that a newly designed apparatus that requires a larger space for installation than a comparable conventional apparatus may not have an appreciable commercial value and will not sell well. Particularly, an image forming apparatus that is produced by technological innovations is required to have dimensions comparable to those of a conventional image forming apparatus if it is installed in a limited space in a book store, a convenience store or the like.

SUMMARY OF THE INVENTION

The present invention has been made in view of the above circumstances and provides an image forming apparatus having dimensions comparable to or smaller than those of conventional color image forming apparatus and adapted to produce an ordinary color copy and also a hard copy of photographic image quality.

According to an aspect of the present invention, an image forming apparatus forming an image on a recording medium by transferring a toner image carried by a sensitized body to the recording medium being conveyed, and then, fixing and discharging the transferred image has a first fixing device, a second fixing device and a switch section explained as follows.

The first fixing device fixes the toner image transferred to the recording medium, and the second fixing device re-fixes the toner image fixed on the recording medium by the first fixing device.

The switch section selects either the first route passing through the first fixing device and allowing the recording medium to be discharged immediately thereafter without passing through the second fixing device or the second route passing through the first fixing device and subsequently the second fixing device before allowing the recording medium to be discharged.

According to the present invention, since two fixing devices are put together in an image forming apparatus and used selectively, the single apparatus is operated in two different modes for forming images in an effective way. Additionally, the second fixing device is so designed as to fix the image on only a recording medium that has been fixed by the first fixing device, and the image formed on the recording medium is not disturbed even if the course of conveying the recording medium is turned. Therefore, the entire image forming apparatus can be made compact to have relatively small dimensions.

BRIEF DESCRIPTION OF THE DRAWINGS

Preferred embodiments of the present invention will be described in detail based on the following figures, wherein.

DESCRIPTION OF THE PREFERRED EMBODIMENTS

Now, the present invention will be described by way of preferred embodiments of the invention.

1st Embodiment

Figure 1:
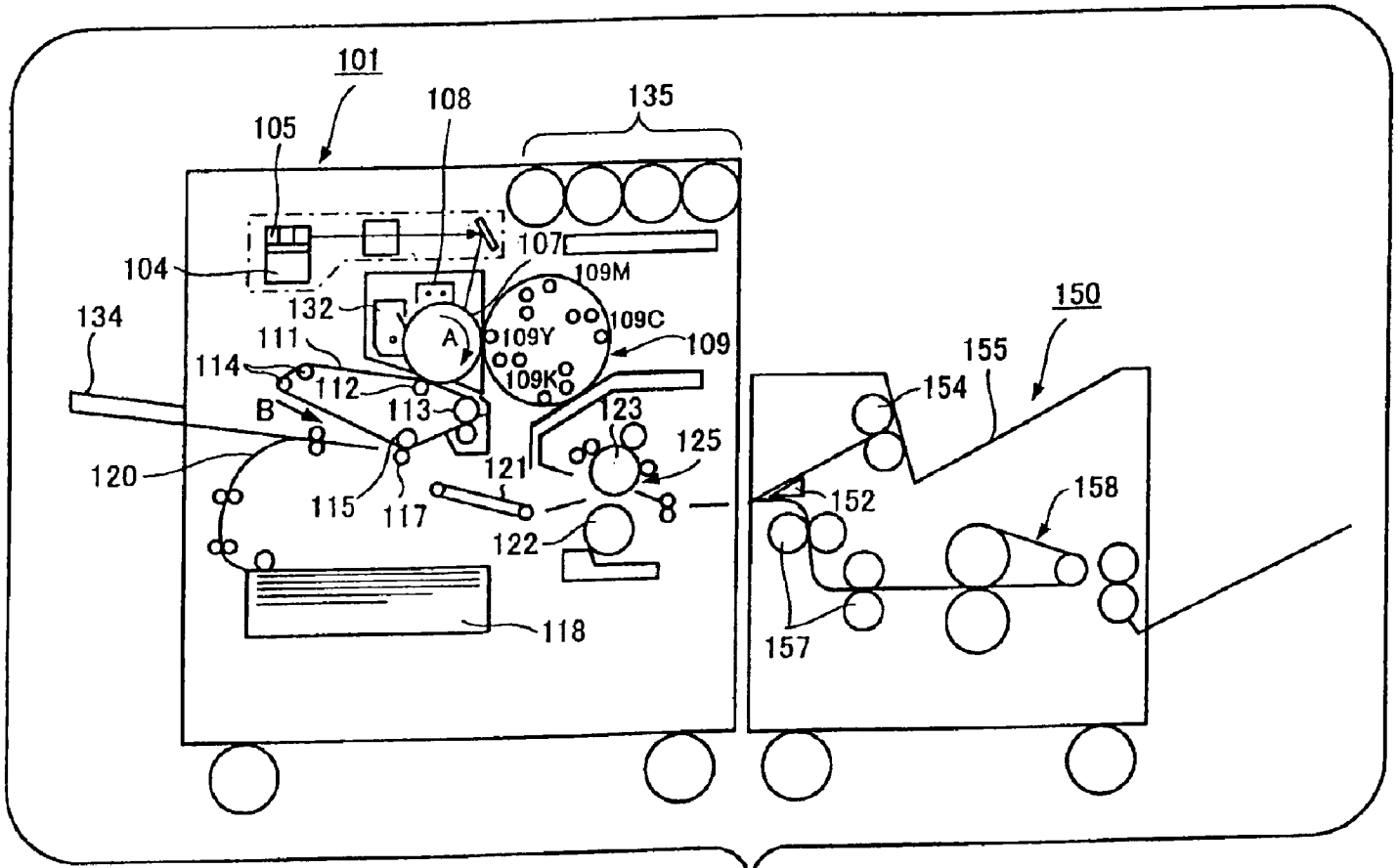
FIG. 1 (PRIOR ART)
FIG. 1 is a schematic view of an example of an image forming apparatus containing a unit that outputs highly glossy images of photographic image quality, illustrating its configuration.
Figure 2:
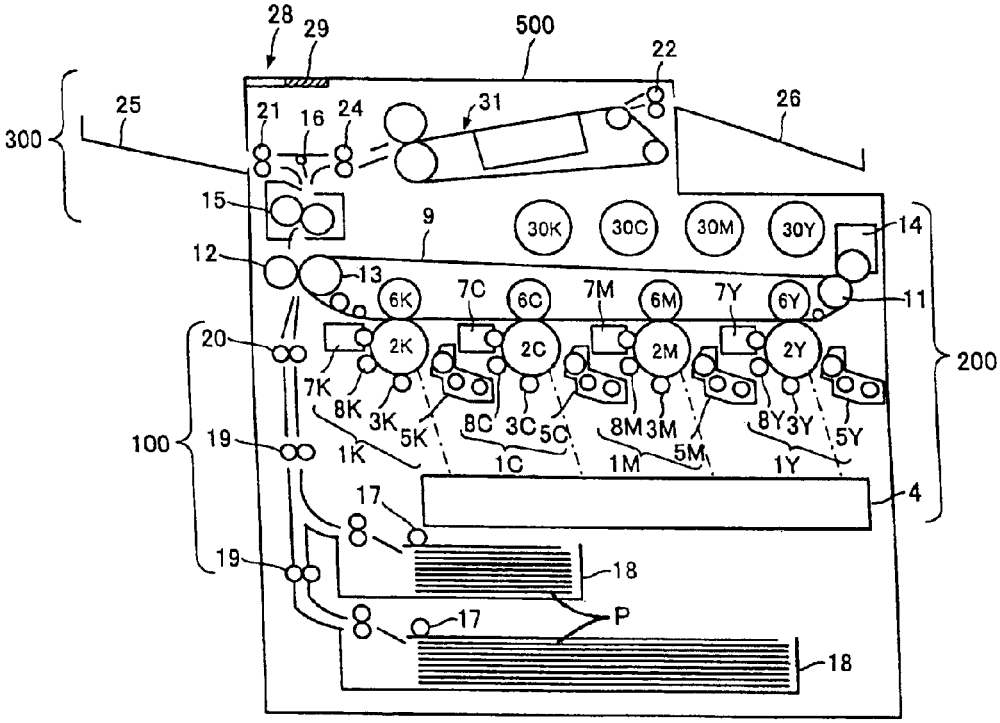
FIG. 2 is a schematic view of the first embodiment, which is a color printer adapted to be able to operate in a photographic image quality mode, illustrating its configuration.

FIG. 2 is a schematic view of the first embodiment, which is a color printer adapted to be able to operate in a photographic image quality mode, illustrating its configuration.

The color printer of FIG. 2 is roughly divided into a paper feeding section 100 for feeding sheets of paper, a toner image forming section 200 for forming toner images and a fixing section 300 for fixing toner images on a sheet of paper. The paper feeding section 100, the toner image forming section 200 and the fixing section 300 are arranged respectively on the lowermost level, on the intermediate level and on the uppermost level in a vertically rectangular parallelepiped enclosure 500. An operation panel 28 is arranged on the top surface of the enclosure 500. The operation panel 28 has a mode selecting section 29 for selecting a mode of operation of forming an image. The apparatus is typically adapted to operate in one of the modes including a black and white mode, a color mode and a photograph image quality mode for example, and the mode selecting section 29 displays these modes. Thus, the user can select a desired one of the operation modes.

The toner image forming section 200 includes four units 1Y, 1M, 1C AND 1K arranged horizontally in series for sequentially forming toner images of yellow (Y) color, magenta (M) color, cyan (C) color and black (K) color, an intermediate transfer belt 9 held by a drive roll 11 and an opposite roll 13 and soon and driven to move around, while being held in contact with the units 1Y, 1M, 1C AND 1K arranged horizontally in series, so as to cause the toner images to be sequentially transferred thereto one on the other, primary transfer rolls 6Y, 6M, 6C and 6K arranged opposite to the respective four units 1Y, 1M, 1C and 1K with the intermediate transfer belt 9 nipped between them to form nip sections and primarily transferring respective colors of toner images formed on the respective units 1Y, 1M, 1C and 1K to the intermediate transfer belt 9, a secondary transfer roll 12 arranged opposite to an opposite roll 13 with the intermediate transfer belt 9 nipped between them to form a nip section so as to cause the toner image transferred to the intermediate transfer belt 9 further to a sheet of paper P, and a belt cleaner 14 arranged opposite to the drive roll 11 with the intermediate transfer belt 9 nipped between them to clean out the residual toner on the intermediate transfer belt 9.

The units 1Y, 1M, 1C and 1K respectively have photosensitized drums 2Y, 2M, 2C and 2K on which toner images are formed, electric chargers 3Y, 3M, 3C and 3K for electrically charging the photosensitized drums 2Y, 2M, 2C and 2K, an exposure section 4 for irradiating the electrically charged photosensitized drums 2Y, 2M, 2C and 2K with light modulated according to the image signal obtained by processing an externally input image data to decompose the original image into images of Y, M, C and K colors and forming electrostatic latent images, developing devices 5Y, 5M, 5C and 5K for developing the electrostatic latent images by respectively applying toners of Y, M, C and K colors to the electrostatic latent images, cleaners 7Y, 7M, 7C and 7K for cleaning out the toner remaining on the photosensitized drums 2Y, 2M, 2C and 2K after transferring the toner images to the intermediate transfer belt 9 and charge eliminators 8Y, 8M, 8C and 8K for eliminating the residual electric charges from the photosensitized drums 2Y, 2M, 2C and 2K. The color printer additionally has toner boxes 30Y, 30M, 30C and 30K for containing respective toners of Y, M, C and K colors so that the toners are supplied to the developing devices 5Y, 5M, 5C and 5K at predetermined respective timings.

With this arrangement, the lateral width of the toner image forming section 200 is limited by the length of the intermediate transfer belt 9 that is driven to move round while being held in contact with the units 1Y, 1M, 1C and 1K that are arranged horizontally in series.

The paper feeding section 100 has plural sheet cassettes 18 containing sheets of paper P, feed rolls 17 to be selectively used for drawing out a sheet of paper P from one of the sheet cassettes 18 at a time, conveyor rolls 19 for conveying the drawn out sheet of paper P and registration rolls 20 for regulating the timing of feeding the sheet of paper P to the secondary transfer position and the posture of the sheet of paper P.

Generally, the A3 size is the largest for sheets of paper P and the plural sheet cassettes 18 are stacked. Therefore, the dimensions of the paper feeding section 100 are limited by the conveyance route for conveying the sheet of paper P drawn out from the sheet cassette 18.

The fixing section 300 has a first fixing device 15 that includes a pair of rolls containing a heat source in the inside and is adapted to apply heat and pressure to the recording medium, or the sheet of paper P, that carries a multicolored toner image and is driven to pass through the nip section formed by the pair of rolls in order to fix the multicolored toner image on the sheet of paper P, a second fixing device 31 that includes a fixing roll having a heat source, a fixing belt held by the fixing roll and adapted to move around and a pressurizing roll disposed opposite to the fixing roll with the fixing belt nipped between them to form a nip section and is adapted to apply heat and pressure to the recording medium that carries a toner image facing the fixing belt in order to fix the toner image, a first discharge tray 25 for receiving the sheet of paper P carrying thereon the image fixed by the first fixing device 15 and discharged from first discharge rolls 21, a second discharge tray 26 for receiving the sheet of paper P carrying thereon the image fixed by the second fixing device 31 and discharged from second discharge rolls 22, a switch section 16 for selecting either the first route for discharging the sheet of paper P subjected to a fixing operation at the first fixing device 15 from the first discharge tray 25 or the second route for re-fixing the image formed on the sheet of paper P and subjected to a fixing operation at the second fixing device 31 and a conveyance route rolls 24 arranged on the second route for conveying the sheet of paper P subjected to a fixing operation at the first fixing device 15 to the second fixing device 31. The sheet of paper P being conveyed on the second route is driven to go into the second fixing device 31 in a direction perpendicular to the direction in which the sheet of paper P comes out from the first fixing device 15. However, the second fixing device 31 is arranged at a position higher than the first fixing device 15 and the sheet of paper P coming out from the first fixing device 15 is located at a position lower than the position where the sheet of paper P is heading for the second fixing device 31. Thus, the sheet of paper P coming out from the first fixing device 15 follows a curved conveyance route having a large radius of curvature before it goes into the second fixing device 31 so that it moves smoothly and the risk of jamming is remarkably low.

In this embodiment, the switch section 16 automatically selects the second route when the photographic image quality mode is selected at the mode selecting section 29 of the operation panel 28. Then, the sheet of paper P carrying an image that has been fixed by the first fixing device 15 is re-fixed by the second fixing device 31 and discharged into the second discharge tray 26. When, on the other hand, the ordinary image quality mode, which may be the black and white mode or the color mode, is selected, the switch section 16 automatically selects the first route so that the sheet of paper carrying an image that has been fixed by the first fixing device 15 is discharged into the first discharge tray 25.

Thus, the image is fixed by the first fixing device 15 when the ordinary image quality mode is selected, whereas the image is fixed by the first fixing device 15 and subsequently re-fixed by the second fixing device 31 when the photographic image quality mode is selected. With this arrangement, the multicolored toner image formed on the sheet of paper P is not disturbed even if the route for conveying the sheet of paper P is switched by the switch section 16 and/or turned. Therefore, it is not necessary to arrange two fixing devices horizontally in series.

While the two fixing devices have respective heat sources, the influence of heat generated by the heat sources is negligible because they are arranged not below but above the toner image forming section 200 that is vulnerable to heat.

The so-called tandem system of arranging four photosensitized drums 2Y, 2M, 2C and 2K in series is adopted for the toner image forming section 200 of this embodiment from the viewpoint of providing a high image forming rate. This means that the intermediate transfer belt 9 of the toner image forming section 200 has the largest horizontal length in the paper feeding section 100, the toner image forming section 200 and the fixing section 300. On the other hand, the first fixing device 15 of the fixing section 300 is arranged right above the secondary transfer roll 12 located at an end of the horizontal part of the intermediate transfer belt 9 while the second fixing device 31 is arranged close to the first fixing device 15 and above the intermediate transfer belt 9. Therefore, the width of the fixing section 300 can be made not greater than that of the toner image forming section 200. Additionally, since the paper feeding section 100 is adapted to draw out a sheet of paper P from one of the sheet cassettes 18 by means of the corresponding feed roll 17 and convey it linearly toward the secondary transfer roll 12 located above the sheet cassettes 18 by way of the conveyor rolls 19 and the registration roll 20 along the wall of the enclosure 500, the width of the paper feeding section 100 can be made to be equal to or not greater than that of the toner image forming section 200.

The printer of this embodiment contains the paper feeding section 100, the toner image forming section 200 and the fixing section 300 arranged respectively on the lowermost level, on the intermediate level and on the uppermost level. Therefore, it stands higher than any conventional printers at least by the distance separating the upper and lower parts of the belt of the second fixing device 31 and the diameter of one of the rolls of the first fixing device 15. The printer may become even higher depending on the positions at which sheets of paper P are discharged from the fixing devices. However, the difference of height between the printer of this embodiment and any conventional color printers can be null or minimal due to the fact that a sheet of paper P is discharged into the first discharge tray 25 from the first fixing device 15 in a direction perpendicular to the direction in which the sheet of paper P carrying the toner image transferred by the secondary transfer roll 12 goes into the first fixing device 15. Also, this is due to the fact that a sheet of paper P is discharged from the second fixing device 31 into the second discharge tray 26 in the same direction as that in which a sheet of paper P goes into the second fixing device 31, and further, the first and second fixing devices 15 and 31 can be arranged substantially at the same level in the printer of this embodiment.

Therefore, the color printer of this embodiment encased in the rectangular parallelepiped enclosure 500 has dimensions that are substantially the same as those of any conventional color printers, while the difference of height between the printer of this embodiment and any conventional color printers is minimal.

When the ordinary image quality mode is selected to form an image by the color printer of this embodiment, exposure light is irradiated to the photosensitized drums 2Y, 2M, 2C and 2K of the four units 1Y, 1M, 1C and 1K of the toner image forming section 200 according to the image signal obtained by processing an externally input image data to decompose the original image into images of Y, M, C and K colors and electrostatic latent images are formed on the respective photosensitized drums 2Y, 2M, 2C and 2K. The electrostatic latent images are then developed respectively by the developing devices 5Y, 5M, 5C and 5K to produce toner images of the different colors. Subsequently, the toner images of the different colors are sequentially transferred to the intermediate transfer belt 9 one on the other by the primary transfer rolls 6Y, 6M, 6C and 6K so that a multicolored toner image is formed on the intermediate transfer belt 9 by superposition. The multicolored toner image is then secondarily transferred to the sheet of paper P conveyed to the transfer position from one of the sheet cassettes 18 of the paper feeding section 100 by way of the corresponding feed rolls 17, the conveyor rolls 19 and the registration rolls 20 by means of the secondary transfer rolls 12. Thereafter, the multicolored toner image secondarily transferred to the sheet of paper P is then fixed by the first fixing device 15 of the fixing section 300.

Meanwhile, the first route is selected by the switch section 16 so that the sheet of paper P on which the image is formed in the ordinary image quality mode is discharged from the first discharge rolls 21 and received by the first discharge tray 25.

When the photographic image quality mode is selected to form an image by the color printer of this embodiment, a multicolored toner image is formed by the toner image forming section 200 and fixed by the first fixing device 15 of the fixing section 300 as in the case where the ordinary image quality mode is selected. And then, since the second route is selected by the switch section 16, the multicolored toner image on the sheet of paper P that has been fixed by the first fixing device 15 is re-fixed by the second fixing device 31 to make a highly glossy image. The sheet of paper P now carrying the image formed in the photographic image quality mode is discharged from the second discharge roll 22 and received by the second discharge tray 26.

While this embodiment is described above in terms of a tandem type color printer using an intermediate transfer belt, the present invention is by no means limited to a tandem type color printer using an intermediate transfer belt. An image forming apparatus may alternatively be realized by adopting a tandem system using a conveyor belt or a 4-cycle system using a single photosensitized drum and an intermediate transfer belt.

Figure 3:
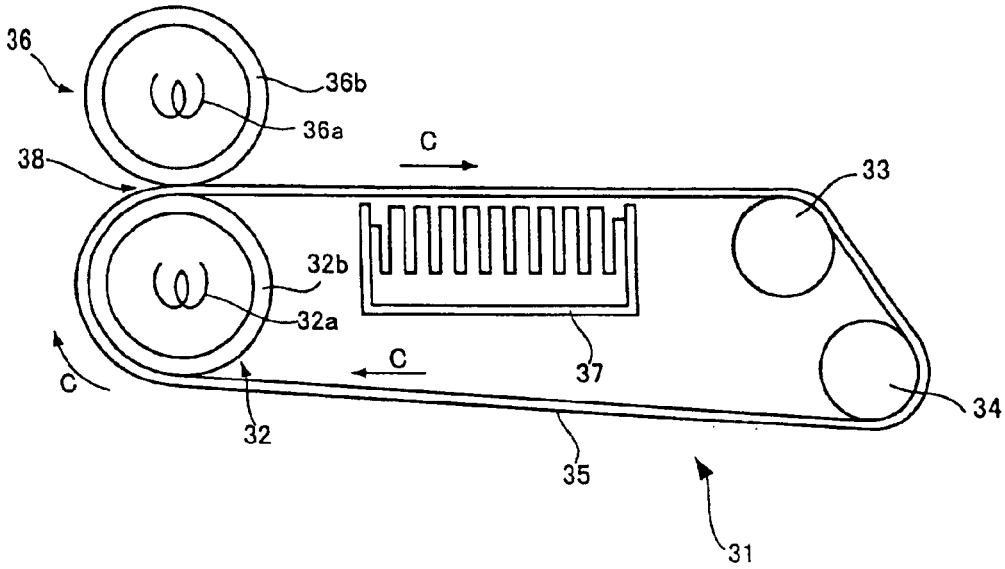
FIG. 3 is a schematic view of the second fixing device, illustrating its configuration.

FIG. 3 is a schematic view of the second fixing device 31, illustrating its configuration.

Referring to FIG. 3, the second fixing device 31 has a fixing roll 32 adapted to be driven to rotate by a drive source, a peeling roll 33, a fixing belt 35 held by the fixing roll 32, the peeling roll 33 and a tension roll 34 and adapted to move round in the direction of arrow C in FIG. 3, a pressurizing roll 36 arranged opposite to the fixing roll 32 with the fixing belt 35 nipped between them to form a nip section 38 and adapted to be driven to rotate by a drive source and apply pressure to the fixing roll 32 and a cooling device 37 adapted to cool the fixing belt 35 at a position downstream relative to the fixing roll 32 and upstream relative to the peeling roll 33 as viewed in the moving direction of the fixing belt 35 as indicated by arrow C in FIG. 3.

The fixing roll 32 is formed by covering a metal core 32*b* containing a halogen heater lamp 32*a* with an elastic layer made of silicon rubber, which is further covered by a releasing layer, although a fixing roll 32 having a different structure may alternatively be used. The metal core 32*b* may advantageously be made of aluminum or SUS from the viewpoint of thermal conductivity and strength.

The pressurizing roll 36 is formed also by covering a metal core 36*b* containing a halogen heater lamp 36*a* with an elastic layer and a releasing layer.

Preferably, the peeling roll 33 is a cylindrical member made of metal from the viewpoint of peeling a sheet of paper P from the fixing belt 35, although it may not necessarily be a revolving body if it does not interfere with the movement of the fixing belt 35. Alternatively, it may be a fixed member.

The cooling device 37 is also referred to as a heat sink, which is formed by a box-shaped member having metal fins that can conduct heat efficiently in the inside. In order to improve the tight contact between the cooling device 37 and the fixing belt 35, an auxiliary member may be provided to press the fixing belt 35 against the cooling device 37 from the side opposite to the side in which the fixing belt 35 is held in contact with the cooling device 37. The heat sink may be replaced by a heat pipe type cooling device in which water is driven to flow in order to exchange heat.

As the sheet of paper P carrying the multicolored toner image that has been fixed by the first fixing device 15 is conveyed to the nip section 38, the sheet of paper P is nipped in the nip section 38 with the multicolored toner image facing to the fixing belt 35. While the toner image is heated and molten there, pressure is applied to the molten toner image. The sheet of paper P is conveyed further while it is held in tight contact with the fixing belt 35 and then the multicolored toner image is cooled by the cooling device 37 to be solidified. Subsequently, the peeling roll 33 peels off the sheet of paper P from the fixing belt 35, utilizing the rigidity of the sheet of paper P.

Because the sheet of paper P is held in tight contact with the fixing belt 35 and heated for a prolonged period of time after passing through the nip section 38, the multicolored toner image is molten sufficiently and the surface is smoothed satisfactorily. Furthermore, because the sheet of paper P that has been heated for a predetermined period of time is cooled by the cooling device 37 from the rear side of the fixing belt 35 to fully solidify the multicolored toner image before it is peeled off by the peeling roll 33, it comes out without losing its gloss.

2nd Embodiment

The second embodiment of an image forming apparatus differs from the first embodiment in that it additionally has an image reading section 40 for reading an original and the second fixing device 31 is unitized. Otherwise, the second embodiment is the same as the first embodiment and, therefore, will be described below only in terms of the differences.

Figure 4:
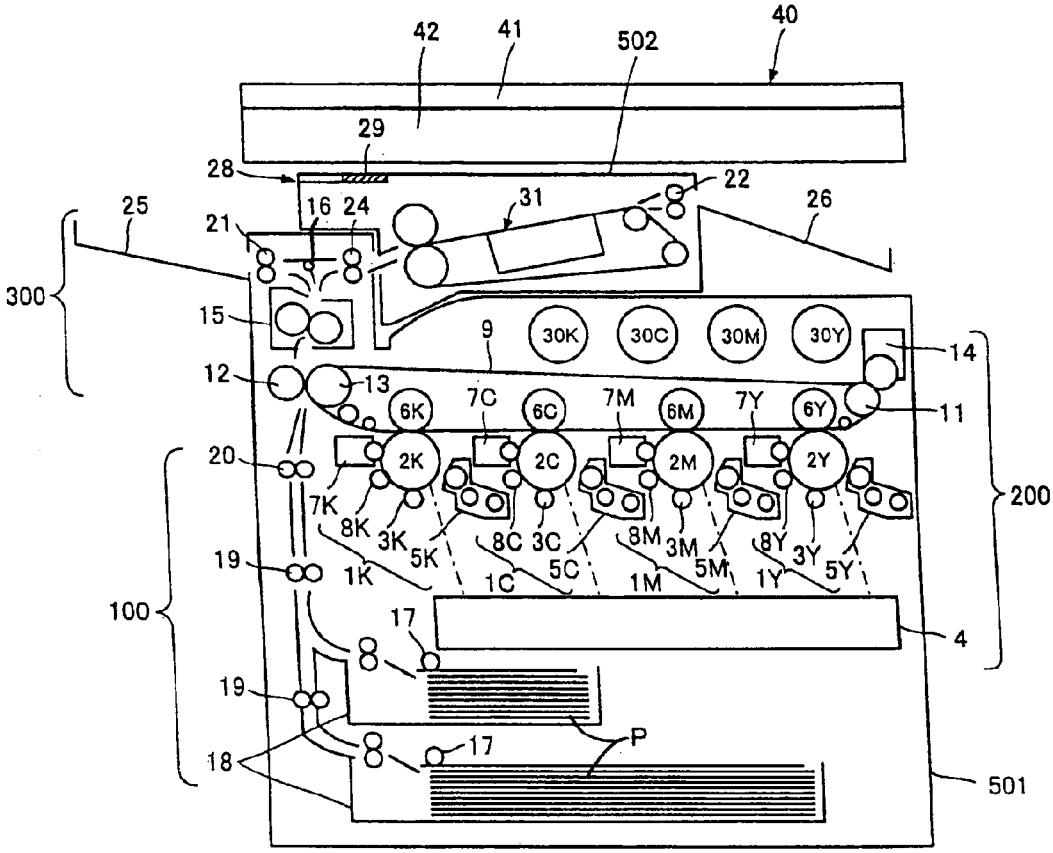
FIG. 4 is a schematic view of the second embodiment, which is a color copying machine adapted to be able to operate in a photographic image quality mode, illustrating its configuration.

FIG. 4 is a schematic view of the second embodiment, which is a color copying machine adapted to be able to operate in a photographic image quality mode, illustrating its configuration.

This embodiment, which is a color copying machine, differs from the first embodiment shown in FIG. 2 in that it additionally has an image reading section 40 and the second fixing device 31 is contained in an enclosure, separable from that of the first fixing device 15, and unitized. All other components are common to the two embodiments. Therefore, the components that are same as those of the first embodiment are denoted respectively by the same reference symbols and will not be described further.

The color copying machine of FIG. 4 is roughly divided into a paper feeding section 100 for feeding sheets of paper, a toner image forming section 200 for forming toner images, a fixing section 300 for fixing toner images on a sheet of paper and an image reading section 40. The paper feeding section 100, the toner image forming section 200 and the fixing section 300 are arranged respectively on the lowermost level, on the intermediate level and on the uppermost level in a vertically rectangular parallelepiped first enclosure 501. The first fixing device 15 of the fixing section 300 is arranged right above the secondary transfer roll 12 of the toner image forming section 200. The second fixing device 31 of the fixing section 300 is unitized and contained in a second enclosure 502 that is removably mounted on the first enclosure 501. A main body section 42 including a platen glass, a light source, an optical system and a CCD sensor and the image reading section 40 having an enclosure section 41 are mounted on the second enclosure 502.

As for the positional relationship between the first fixing device 15 and the second fixing device 31 of the fixing section 300 of this embodiment, the second fixing device 31 is located above the first fixing device 15 as in the case of the first embodiment. The sheet of paper P being conveyed on the second is driven to go into the second fixing device 31 in a direction perpendicular to the direction in which the sheet of paper P comes out from the first fixing device 15. However, the sheet of paper P coming out from the first fixing device 15 follows a curved conveyance route having a large radius of curvature before it goes into the second fixing device 31 so that it moves smoothly and the risk of jamming is remarkably low.

The so-called tandem system of arranging four photosensitized drums 2Y, 2M, 2C and 2K in series is adopted for the toner image forming section 200 of this embodiment from the viewpoint of providing a high image forming rate. Therefore, the intermediate transfer belt 9 of the toner image forming section 200 has the largest horizontal length in the paper feeding section 100 and the toner image forming section 200. In the paper feeding section 100, on the other hand, a sheet of paper P is drawn out from one of the sheet cassettes 18 by means of the corresponding feed roll 17 and conveyed substantially vertically toward the secondary transfer roll 12 located above the sheet cassettes 18 by way of conveyor rolls 19 and registration rolls 20. Therefore, the width of the paper feeding section 100 can be made equal to or not greater than that of the toner image forming section 200.

On the other hand, the first fixing device 15 of the fixing section 300 is arranged right above the secondary transfer roll 12 of the toner image forming section 200 and contained in the first enclosure 501, whereas the second fixing device 31 is contained in the second enclosure 502 that is smaller than the first enclosure 501, which is removably mounted on the first enclosure 501 approximately at the center of the first enclosure 501. The dimensions of the image reading section 40 can be made equal to or not greater than the first enclosure 501.

Since the paper feeding section 100 and the toner image forming section 200 are arranged respectively on the lowermost level and on the uppermost level in the first enclosure 501 and the second enclosure 502 containing the second fixing device 31 is mounted on the first enclosure 501, the height of the second embodiment is higher than conventional color printer by at least the height of the second enclosure 502. While the image reading section 40 of the color copying machine of this embodiment is mounted on the second enclosure 502, the level of the color copying machine can be held lower than the extended arms of a standing grown up person. This is because the first route along which a sheet of paper P is discharged from the first fixing device 15 toward the first discharge tray 25 is perpendicular to the direction in which a sheet of paper P carrying a toner image transferred by the secondary transfer roll 12 goes into the first fixing device 15, and the direction in which a sheet of paper P is discharged from the second fixing device 31 toward the second discharge tray 26 is the same with the direction of the second route along which a sheet of paper P goes into the second fixing device 31. Therefore, the color copying machine of this embodiment that includes three enclosures can be made to have dimensions comparable to those of conventional color printers and its height can be held to such a level that the user does not feel any difficulty when he or she operates the machine.

If the size of the recording medium to be used for forming an image of photographic image quality is limited to that of A6 or smaller, for example, both the width of the fixing belt 35 of the second fixing device 31 and the length of the route of the fixing belt 35 can be reduced along with the diameter of the fixing roll 32 and that of the pressurizing roll 36 so that the level of the second fixing device 31 can be substantially held to that of the first fixing device 15 and, at the same time, the second enclosure 502 can be made to show smaller dimensions.

For causing the image reading section 40 to read an original, the enclosure section 41 is opened and the original is placed on the platen glass of the main body section 42. As the start button of the operation panel 28 is depressed, the light source in the main body section 42 is driven to move and scan the original by the beam of light emitted from the light source. The reflected beam of light is received by the CCD sensor by way of the optical system. The CCD sensor outputs a light receiving signal for each of the RGB colors.

When the ordinary image quality mode is selected to form an image by the color copying machine of this embodiment, exposure light is irradiated to the photosensitized drums 2Y, 2M, 2C and 2K of the four units 1Y, 1M, 1C and 1K of the toner image forming section 200, in which the light is modulated according to the image signal obtained by processing an externally input image data to decompose the original image into images of Y, M, C and K colors and electrostatic latent images are formed on the respective photosensitized drums 2Y, 2M, 2C and 2K. The electrostatic latent images are then developed respectively by the developing devices 5Y, 5M, 5C and 5K to produce toner images of the different colors. Subsequently, the toner images of the different colors are sequentially transferred to the intermediate transfer belt 9 one on the other by the primary transfer rolls 6Y, 6M, 6C and 6K so that a multicolored toner image is formed on the intermediate transfer belt 9 by superposition. The multicolored toner image is then secondarily transferred to the sheet of paper P conveyed to the transfer position from one of the sheet cassettes 18 of the paper feeding section 100 by way of the corresponding feed rolls 17, the conveyor rolls 19 and the registration roll 20 by means of the secondary transfer rolls 12. Thereafter, the multicolored toner image secondarily transferred to the sheet of paper P is then fixed by the first fixing device 15 as it passes through the first fixing device 15. Since the first route is selected by the switch section 16 in this mode of operation, the sheet of paper P that carries an image formed in the ordinary image quality mode is discharged from the first discharge rolls 21 and received by the first discharge tray 25.

When the photographic image quality mode is selected to form an image by the color copying machine of this embodiment, a multicolored toner image is formed by the toner image forming section 200 and fixed by the first fixing device 15 of the fixing section 300 when it passes through the first fixing device 15 as in the case where the ordinary image quality mode is selected. Since the second route is selected by the switch section 16, the multicolored toner image on the sheet of paper P that has passed through the first fixing device 15 is re-fixed by the second fixing device 31 to make a highly glossy image. The sheet of paper P now carrying the image formed in the photographic image quality mode is discharged from the second discharge roll 22 and received by the second discharge tray 26.

While this embodiment is described above in terms of a tandem type color copying machine using an intermediate transfer belt, the present invention is by no means limited to a tandem type using an intermediate transfer belt. An image forming apparatus according to the invention may alternatively be realized by adopting a tandem system using a conveyor belt or a 4-cycle system using a single photosensitized drum and an intermediate transfer belt.

Figure 5:
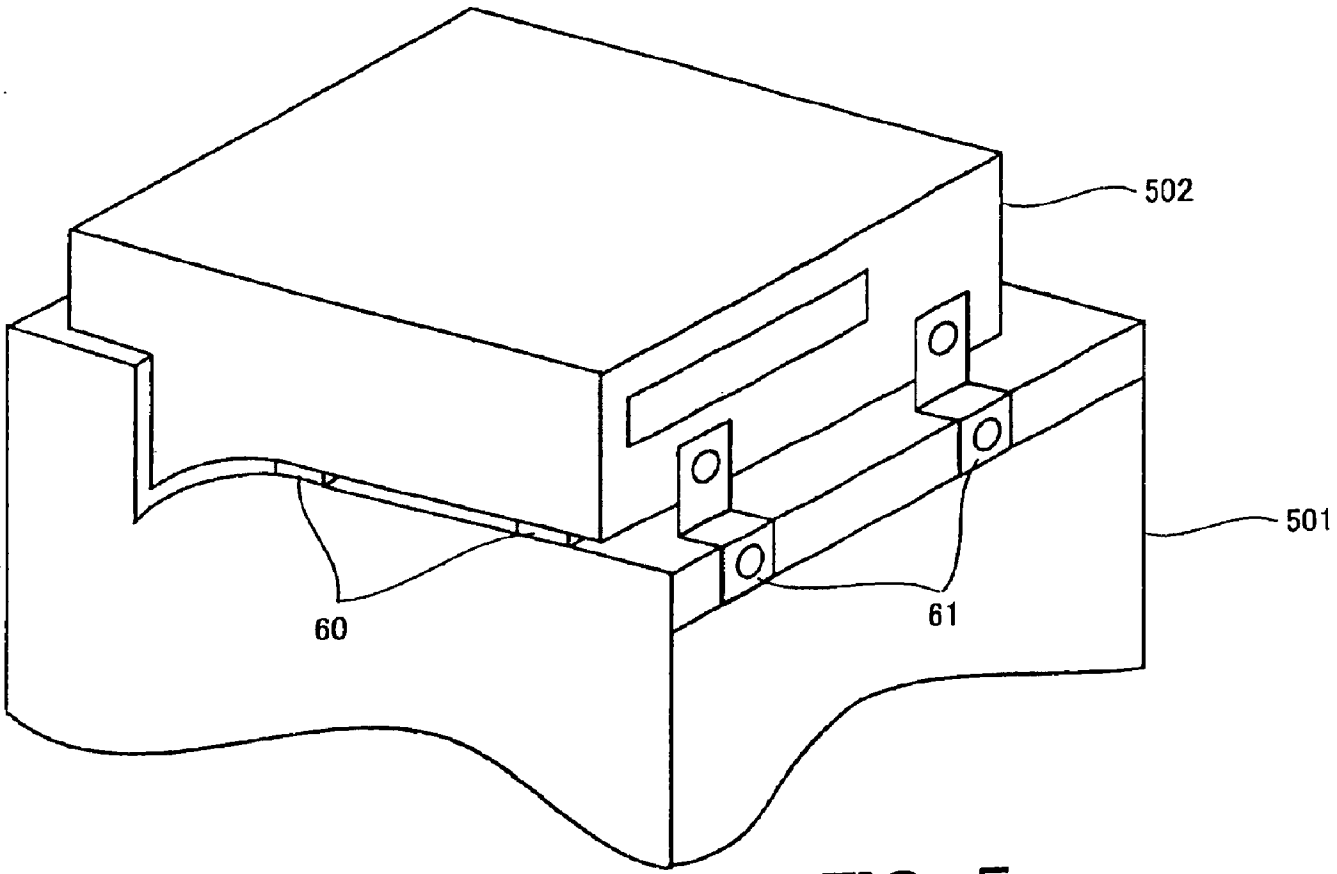
FIG. 5 is a schematic perspective view of the second enclosure containing the second fixing device, illustrating how it is supported.

FIG. 5 is a schematic perspective view of the second enclosure containing the second fixing device 31, illustrating how it is supported.

As shown in FIG. 5, the second enclosure 502 containing the second fixing device 31 is provided at the bottom thereof with plural support members 60 that is placed on the first enclosure 501 and rigidly secured to the first enclosure 501 by means of securing members 61.

While the second enclosure 502 of this embodiment is placed on and rigidly secured to the first enclosure 501 in the above description, it may alternatively be so arranged that the image reading section 40 is rigidly secured to the first enclosure 501 and the second enclosure 502 is suspended from and held by the image reading section 40.

Since the second fixing device 31 is unitized and contained in the second enclosure 502, which is removably mounted on the first enclosure 501, it may be annexed to an existing color copying machine or a color printer to upgrade the machine or the printer so as to make it capable of printing images in the photographic image quality mode. Additionally, since the second fixing device 31 is contained in the second enclosure 502, which is separable from the first enclosure 501, it is easy to remove only the second fixing device 31 for servicing.

3rd Embodiment

The third embodiment differs from the first embodiment only in terms of the first and second fixing devices 15 and 31. More specifically, while the largest fixing width of the first fixing device 15 and that of the second fixing device 31 are equal to each other in the first embodiment, they are different from each other in this embodiment. Otherwise, the third embodiment is identical with the first embodiment and, therefore, only the difference will be described below.

Figure 6:
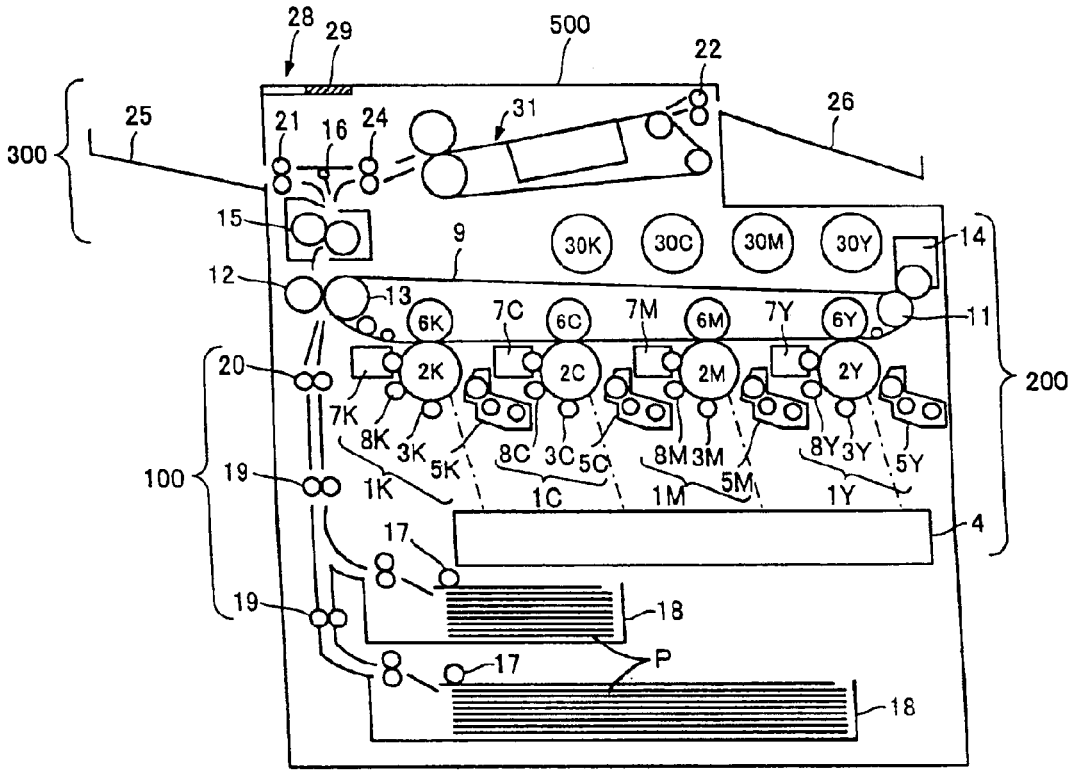
FIG. 6 is a schematic view of the third embodiment, which is a color printer adapted to be able to operate in a photographic image quality mode, illustrating its configuration.

FIG. 6 is a schematic view of the third embodiment, which is a color printer adapted to be able to operate in a photographic image quality mode, illustrating its configuration.

Since the color printer of this embodiment has a configuration the same as the color printer of the first embodiment, the components that are the same as those of the first embodiment are denoted respectively by the same reference symbols and will not be described further.

As shown in FIG. 6, the fixing section 300 has a first fixing device 15 that includes a pair of rolls containing a heat source in the inside and is adapted to apply heat and pressure to the recording medium, or a sheet of paper P, that carries a multicolored toner image and is driven to pass through the nip section formed by the pair of rolls in order to fix the multicolored toner image on the sheet of paper P, a second fixing device 31 that includes a fixing roll having a heat source, a fixing belt held by the fixing roll and adapted to move round and a pressurizing roll disposed opposite to the fixing roll with the fixing belt nipped between them to form a nip section and is adapted to apply heat and pressure to the recording medium that carries a toner image facing the fixing belt in order to fix the toner image on the recording medium, a first discharge tray 25 for receiving the sheet of paper P carrying thereon the image fixed by the first fixing device 15 and discharged from the first discharge rolls 21, a second discharge tray 26 for receiving the sheet of paper P carrying thereon the image fixed by the second fixing device 31 and discharged from the second discharge rolls 22, a switch section 16 for selecting either the first route for delivering the sheet of paper P subjected to a fixing operation at the first fixing device 15 to discharge from the first discharge tray 25 or the second route for re-fixing the image formed on the sheet of paper P and subjected to a fixing operation at the second fixing device 31 and conveyance route rolls 24 arranged on the second route for conveying the sheet of paper P subjected to a fixing operation at the first fixing device 15 to the second fixing device 31.

The length of the rotary shafts of the fixing roll, the peeling roll and the tension roll of the second fixing device 31 is made shorter than that of the rotary shafts of the pair of rolls of the first fixing device 15, while the largest fixing width of the second fixing device 31 is made smaller than the largest fixing width of the first fixing device 15. The middle section of the largest fixing width of the second fixing device 31, that is, the middle section of each of the rotary shafts of the fixing roll, the peeling roll and the tension roll, is located closer to the endways side in FIG. 6 than the middle section of the largest fixing width of the first fixing device 15, that is, the middle section of each of the rotary shafts of the pair of rolls.

With this arrangement, while the sizes of sheets of papers that can be used for forming an image of photographic image quality by way of a fixing process conducted at the second fixing device 31 are limited, the sheet of paper P that is delivered from the color printer can be taken out easily because the second fixing device 31 is located close to the endways side in FIG. 6.

While this embodiment is described above in terms of a tandem type color printer using an intermediate transfer belt, the present invention is by no means limited to a tandem type color printer using an intermediate transfer belt. An image forming apparatus according to the invention may alternatively be realized by adopting a tandem system using a conveyor belt.

Figure 7:
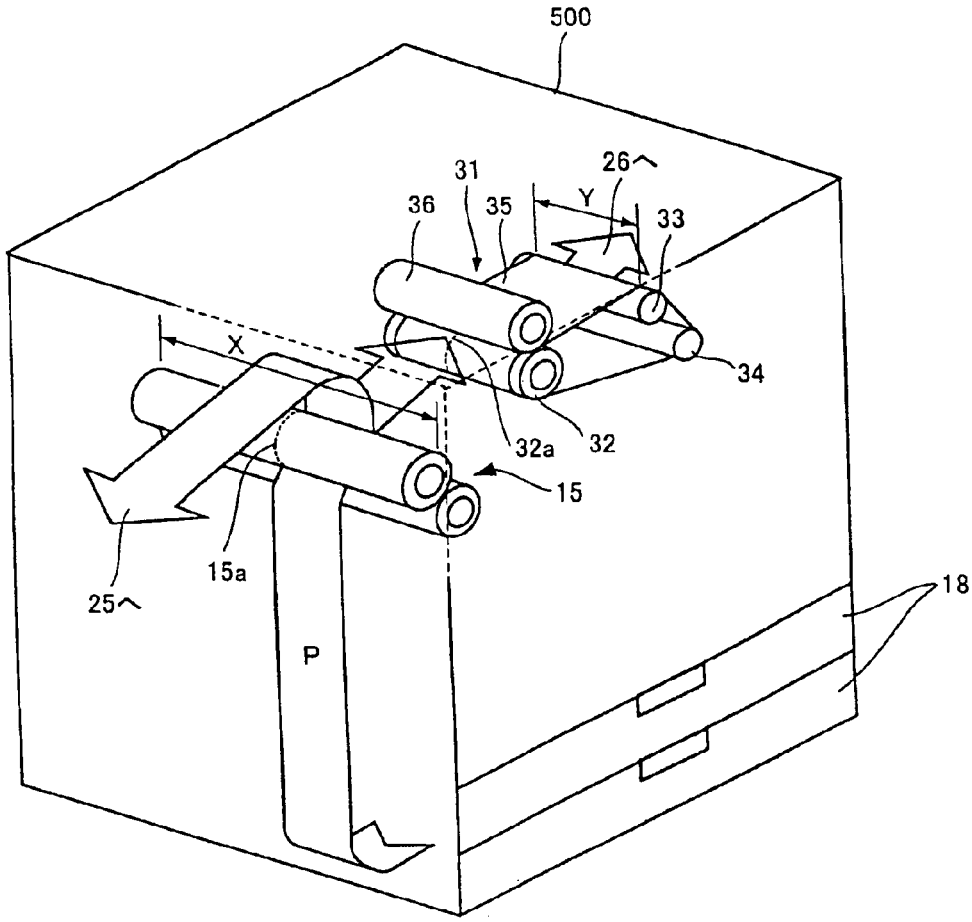
FIG. 7 is a schematic perspective view illustrating the flow of the sheet of paper P passing through the fixing section and the largest fixing width of the first and second fixing devices.

FIG. 7 is a schematic perspective view, illustrating the flow of the sheet of paper P passing through the fixing section and the largest fixing width of the first and second fixing devices 15 and 31.

As shown in FIG. 7, the first fixing device 15 is a roll fixing device having a pair of rolls, whereas the second fixing device 31 is a belt fixing device having a fixing belt 35 held by and adapted to move around a fixing roll 32 containing a heat source in the inside, a peeling roll 33 and a tension roll 34 and a pressurizing roll 36 disposed opposite to the fixing roll 32 with the fixing belt 35 nipped between them to form a nip section there. The shafts of the fixing roll 35, the peeling roll 33 and the tension roll 34 are shorter than the shafts of the rollers of the first fixing device 15 and the largest fixing width Y of the second fixing device 31 is smaller than the largest fixing width X of the first fixing device 15. The first fixing device 15 and the second fixing device 31 are arranged close to the side of the color printer where the user operates the color printer or puts a sheet cassette 18 into or draw it out from the enclosure 500 while standing and the transversal middle section 32*a* of the fixing roll 32 is located closer to the front side (the side of the color printer where the user puts a sheet cassette 18 into or draw it out from the enclosure 500) than the transversal middle sections 15*a* of the rolls of the first fixing device 15.

The sheet of paper P conveyed vertically upward from the lowermost level is slightly inclined when it goes into the first fixing device 15 and comes out obliquely upward from the first fixing device 15. A sheet of paper P carrying an image formed in the ordinary image quality mode is turned by 90° before it is discharged into the first discharge tray 25. A sheet of paper P carrying an image formed in the photographic image quality mode is driven to move straight forward and go into the second fixing device 31 along the direction in which it comes out from the first fixing device 15. Then, it moves on along the fixing belt 35 that is moving round. Thereafter, it is peeled off by the peeling roll 33 and moves straight forward until it is discharged into the second discharge tray 26.

With the above described arrangement of making the largest fixing width Y of the second fixing device 31 smaller than the largest fixing width X of the first fixing device 15, the sizes of sheets of paper that can be used for forming images of photographic image quality by way of a fixing step using the second fixing device 31 are limited. However, the power consumption rate can be reduced by this arrangement and the diameter of the fixing roll 32, that of the pressurizing roll 36 and the length of the fixing belt 35 can be reduced. As a result, it is possible to make the second fixing device 31 small and thin so as to reduce the space occupied by the second fixing device 31 as well as its cost. Additionally, since the second fixing device 31 is located close to the front side of the color printer, the sheet of paper carrying an image of photograph image quality that is discharged into the second discharge tray 26 can be taken out with ease and the operation of servicing the second fixing device 31 is facilitated.

4th Embodiment

The fourth embodiment of image forming apparatus according to the invention differs from the third embodiment in that it additionally has an image reading section 40 for reading the original and the second fixing device 31 is put into another enclosure 502 and unitized. All other components are common to the two embodiments. The technique used in this embodiment for supporting the enclosure containing the second fixing device 31 is same as that of the second embodiment. Therefore, this embodiment will be described below only in terms of the differences.

Figure 8:
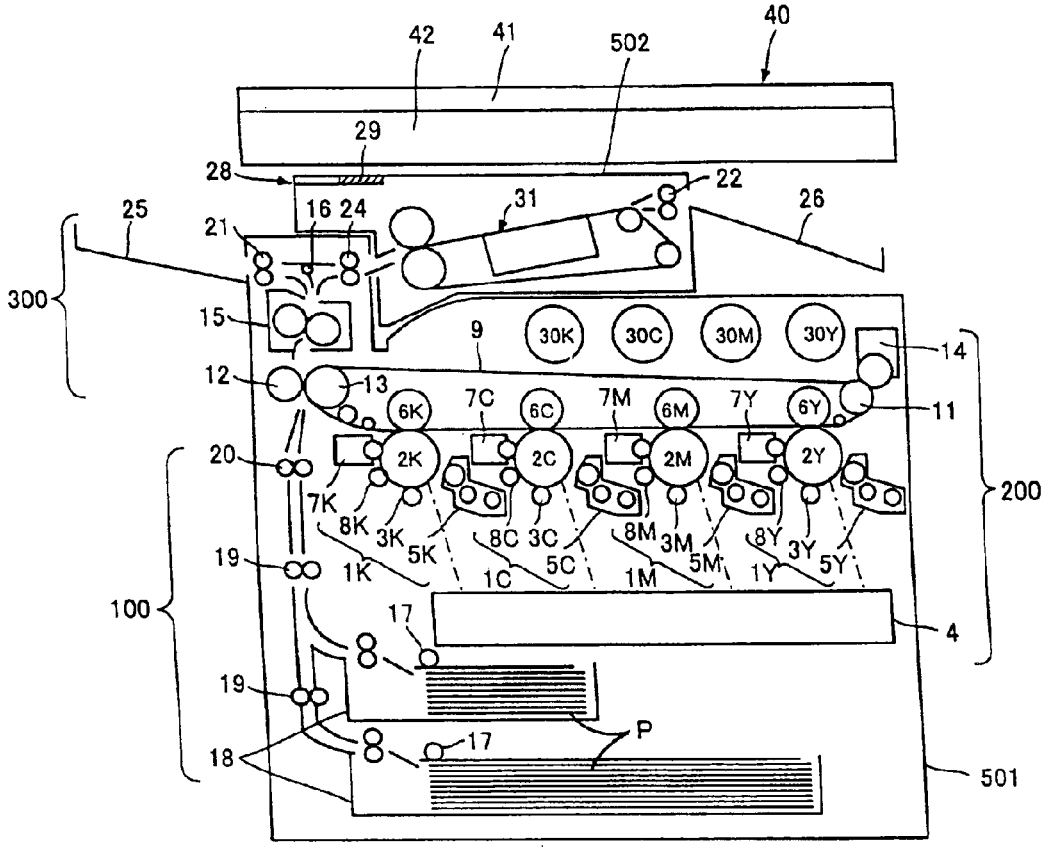
FIG. 8 is a schematic view of the fourth embodiment, which is a color copying machine adapted to be able to operate in a photographic image quality mode, illustrating its configuration.

FIG. 8 is a schematic view of the fourth embodiment, which is a color copying machine adapted to be able to operate in a photographic image quality mode, illustrating its configuration.

Since the color copying machine of this embodiment has components same as those of the second embodiment, those components are denoted respectively by the same reference symbols and will not be described further.

The color copying machine of FIG. 8 is roughly divided into a paper feeding section 100 for feeding sheets of paper, a toner image forming section 200 for forming toner images, a fixing section 300 for fixing toner images on a sheet of paper and an image reading section 40. The paper feeding section 100, the toner image forming section 200 and the fixing section 300 are arranged respectively on the lowermost level, on the intermediate level and on the uppermost level in a vertically rectangular parallelepiped first enclosure 501. The first fixing device 15 of the fixing section 300 is arranged above the secondary transfer roll 12 of the toner image forming section 200. The second fixing device 31 of the fixing section 300 is unitized and contained in a second enclosure 502 that is removably mounted on the first enclosure 501.

As in the case of the third embodiment, the length of the shafts of the fixing roll 32, the peeling roll 33 and the tension roll 34 of the second fixing device 31 is made shorter than that of the rotary shafts of the pair of rolls of the first fixing device 15, while the largest fixing width Y of the second fixing device 31 is made smaller than the largest fixing width X of the first fixing device 15. The middle section of the largest fixing width Y of the second fixing device 31, that is, the middle section 32*a* of the rotary shaft of the fixing roll 32 is located closer to the endways side in FIG. 8 than the middle section of the largest fixing width X of the first fixing device 15, that is, the middle section 15*a* of each of the rotary shafts of the pair of rolls.

A main body section 42 including a platen glass, a light source, an optical system and a CCD sensor and the image reading section 40 having an enclosure section 41 are mounted on the second enclosure 502.

The so-called tandem system of arranging four photosensitized drums 2Y, 2M, 2C and 2K in series is adopted for the toner image forming section 200 of this embodiment from the viewpoint of providing a high image forming rate. Therefore, the intermediate transfer belt 9 of the toner image forming section 200 has the largest horizontal length in the paper feeding section 100 and the toner image forming section 200. In the paper feeding section 100, on the other hand, a sheet of paper P is drawn out from one of the sheet cassettes 18 by means of the corresponding feed roll 17 and conveyed substantially vertically toward the secondary transfer roll 12 located above the sheet cassettes 18 by way of the conveyor rolls 19 and the registration rolls 20. Therefore, the width of the paper feeding section 100 can be made equal to or not greater than that of the toner image forming section 200.

On the other hand, the first fixing device 15 of the fixing section 300 is arranged right above the secondary transfer roll 12 of the toner image forming section 200 and contained in the first enclosure 501. The diameter of the fixing roll 32, that of the pressurizing roll 36 and the length of the fixing belt 35 of the second fixing device 31 can be reduced so that the lateral width of the fixing section 300 can be narrower than that of the toner image forming section 200.

The dimensions of the image reading section 40 can be made equal to or not greater than those of the first enclosure 501.

The second fixing device 31 can be contained in a second enclosure 502 whose dimensions are smaller than the first enclosure 501.

If the paper feeding section 100 and the toner image forming section 200 are arranged respectively on the lowermost level and on the uppermost level in the first enclosure 501 and the second enclosure 502 containing the second fixing device 31 of the fixing section 300 is mounted on the first enclosure 501, the height of the fourth embodiment is higher than conventional color printer by at least the height of the second enclosure 502. The height of the color copying machine of this embodiment can be held lower than the extended arms of a standing grown up person. This is because the first route along which a sheet of paper P is discharged from the first fixing device 15 toward the first discharge tray 25 is perpendicular to the direction in which a sheet of paper P carrying a toner image transferred by the secondary transfer roll 12 goes into the first fixing device 15, and the direction in which a sheet of paper P is discharged from the second fixing device 31 toward the second discharge tray 26 is the same with the direction of the second route along which a sheet of paper P goes into the second fixing device 31.

Therefore, the color copying machine of this embodiment that includes three cabinets can be made to have dimensions comparable to those of conventional color printers and its height can be held to such a level that the user does not feel any difficulty when he or she operates the machine.

Since the second fixing device 31 is unitized and contained in the second enclosure 502, which is removably mounted on the first enclosure 501, so as to be separated from the first fixing device 15, it may be annexed to an existing color copying machine or a color printer to grade up the machine or the printer so as to make it capable of printing images in the photographic image quality mode.

While this embodiment is described above in terms of a tandem type color copying machine using an intermediate transfer belt, the present invention is by no means limited to a tandem type color printer using an intermediate transfer belt. An image forming apparatus according to the present embodiment may alternatively be realized by adopting a tandem system using a conveyor belt.

What is claimed is:

1. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged;

a sheet containing section that contains the recording medium arranged below a position for transferring the toner image to the recording medium; and a conveyance route that linearly conveys the recording medium sent out from the sheet containing section toward the toner image transferring position.

2. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein the first fixing device is arranged right above the position for transferring the toner image.

3. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein a direction in which the recording medium carrying the image re-fixed by the second fixing device is discharged when the second route is selected by the switch section is opposite to the direction in which the recording medium is discharged when the first route is selected by the switch section.

4. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein the direction in which the recording medium carrying the image re-fixed by the second fixing device is discharged when the second route is selected by the switch section is the same as a direction in which the recording medium goes into the second fixing device.

5. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein the second fixing device has a maximum fixing width smaller than a maximum fixing width of the first fixing device, and a middle section of the maximum fixing width of the second fixing device is arranged closer to a front side of the apparatus than a middle section of the maximum fixing width of the first fixing device.

6. The apparatus according to claim 5, wherein the second fixing device is a removable.

7. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged;

an image reading Section that is arranged above an image forming section forming an image on the recording medium and adapted to read an original and obtain an image signal, wherein a position where the recording medium carrying the image re-fixed by the second fixing device is discharged when the second route is selected by the switch section is located below the image reading section and between the image reading section and the image forming section.

8. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein the apparatus is adapted to operate in any of a plurality of image forming modes and further comprises:

a mode selecting section that selects one of the plurality of modes; and the switch section is adapted to select either the first route or the second route according to the mode selected by the mode selecting section, wherein the plurality of image forming modes to be selected by the mode selecting section include a photograph image quality mode that forms an image of photograph image quality on the recording medium; and wherein the switch section is adapted to select the second route when the photograph image quality mode is selected by the mode selecting section.

9. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein the first fixing device is arranged above the position for transferring the toner image.

10. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein a direction in which the recording medium is discharged when the first route is selected by the switch section intersects a direction in which the recording medium goes into the first fixing device.

11. An image forming apparatus forming an image on a recording medium by transferring a toner image carried by a sensitized body to the recording medium being conveyed, and then, fixing and discharging the transferred image, the apparatus comprising:

a first fixing device that fixes the toner image transferred to the recording medium;

a second fixing device that re-fixes the toner image fixed on the recording medium by the first fixing device; and a switch section that selects either one of a first route and a second route, the first route passing through the first fixing device and allowing the recording medium to be discharged immediately thereafter without passing through the second fixing device, the second route passing through the first fixing device and subsequently the second fixing device and allowing the recording medium to be discharged, wherein the second fixing device is arranged at a position higher than the first fixing device.

12. The apparatus according to claims 9, 10, or 11, wherein the first and second fixing devices are contained in an enclosure.

13. The apparatus according to claims 9, 10, or 11, wherein the second fixing device is contained in an enclosure different from an enclosure containing the first fixing device.

14. The apparatus according to claims 9, 10, or 11, wherein the second fixing device is a belt-type fixing device having a fixing roll containing a heat source, a fixing belt held by the fixing roll so as to move round, and a pressurizing roll arranged opposite to the fixing roll, in which the fixing belt is nipped between the pressurizing roll and the fixing roll to form a nip section, and the second fixing device is adapted to fix the toner image on the recording medium by applying heat and pressure to the recording medium carrying the toner image facing the fixing belt in the nip section.

15. The apparatus according to claim 9, 10, or 11, further comprising:

a plurality of photosensitized drums arranged in a horizontal direction to form a toner image, wherein the sensitized body is an intermediate transfer belt adapted to move round by way of the plurality of photosensitized drums and sequentially transfer toner images formed on the plurality of photosensitized drums.

16. The apparatus according to claim 15, wherein the second fixing device is arranged above the intermediate transfer belt.

17. The apparatus according to claim 11, wherein the first fixing device is adapted to send out the recording medium at a position lower than a position where the recording medium goes into the second fixing device.

* * * * *